US010793417B2

(12) United States Patent
Homann et al.

(10) Patent No.: US 10,793,417 B2
(45) Date of Patent: Oct. 6, 2020

(54) DEVICE FOR FUELLING MOTOR VEHICLES WITH LIQUEFIED GAS

(71) Applicant: Brugg Rohr AG Holding, Brugg (CH)

(72) Inventors: Joern Homann, Hannover (DE); Thomas Albrecht, Barsinghausen (DE); Marc Oliver Herbst, Hohnhorst (DE)

(73) Assignee: BRUGG ROHR AG HOLDING, Brugg (CH)

( * ) Notice: Subject to any disclaimer, the term of this patent is extended or adjusted under 35 U.S.C. 154(b) by 271 days.

(21) Appl. No.: 15/771,093

(22) PCT Filed: Oct. 26, 2016

(86) PCT No.: PCT/EP2016/075730
§ 371 (c)(1),
(2) Date: Apr. 30, 2018

(87) PCT Pub. No.: WO2017/076706
PCT Pub. Date: May 11, 2017

(65) Prior Publication Data

US 2018/0312390 A1 Nov. 1, 2018

(30) Foreign Application Priority Data

Nov. 3, 2015 (DE) ..... 10 2015 118 830

(51) Int. Cl.
*F17C 5/04* (2006.01)
*B67D 7/04* (2010.01)
*B67D 7/54* (2010.01)
*B67D 7/78* (2010.01)

(52) U.S. Cl.
CPC ..... *B67D 7/0478* (2013.01); *B67D 7/54* (2013.01); *B67D 7/78* (2013.01); *F17C 5/04* (2013.01);
(Continued)

(58) Field of Classification Search
CPC ..... B67D 7/0478; B67D 7/78; B67D 7/54; F17C 5/04; F17C 2260/036;
(Continued)

(56) References Cited

U.S. PATENT DOCUMENTS 4,523,548 A * 6/1985 Engel ..... F02M 21/029 123/1 A
4,570,679 A * 2/1986 Schippl ..... F16L 59/141 138/113
(Continued)

FOREIGN PATENT DOCUMENTS

DE 721995 C 6/1942
DE 1650060 A1 8/1970
(Continued)

*Primary Examiner* — Marina A Tietjen
(74) *Attorney, Agent, or Firm* — Leydig, Voit & Mayer, Ltd.

(57) ABSTRACT

A device for fueling motor vehicles with a fluid used as a fuel and composed of liquefied gas, in particular liquefied natural gas, includes: at least one storage container; a cooling device; at least one conveying device for feeding the fluid from the at least one storage container to at least one fueling device for motor vehicles; and at least one line for supplying the fluid to the fueling device. The at least one line includes a media-conveying central pipeline as a medium pipe and at least one additional media-conveying pipeline that is arranged concentrically with respect to the central pipeline and defines an annular space together with the media-conveying central pipeline. The media-conveying central pipeline and the at least one annular space supply and return the fluid or a gas flow. The at least one additional media-conveying pipeline is surrounded by a jacket pipe.

13 Claims, 6 Drawing Sheets

(52) U.S. Cl.
CPC ..... *F17C 2205/0355* (2013.01); *F17C 2205/0358* (2013.01); *F17C 2205/0361* (2013.01); *F17C 2205/0364* (2013.01); *F17C 2221/033* (2013.01); *F17C 2223/0123* (2013.01); *F17C 2223/0161* (2013.01); *F17C 2260/036* (2013.01); *F17C 2260/038* (2013.01); *F17C 2265/032* (2013.01); *F17C 2265/065* (2013.01)

(58) Field of Classification Search
CPC ..... F17C 2223/0123; F17C 2205/0361; F17C 2265/032; F17C 2205/0355; F17C 2205/0364; F17C 2221/033; F17C 2205/0358; F17C 2265/065; F17C 2223/0161; F17C 2260/038
See application file for complete search history.

(56) References Cited

U.S. PATENT DOCUMENTS 5,076,242 A * 12/1991 Parker ..... F02M 55/007 123/468
5,315,831 A 5/1994 Goode et al.
5,353,849 A 10/1994 Sutton et al.
5,537,824 A 7/1996 Gustafson et al.
2002/0056278 A1* 5/2002 Zurecki ..... F17O 6/00 62/50.1
2004/0231741 A1 11/2004 Kraus et al.
2006/0260387 A1* 11/2006 Baillargeon ..... B67D 7/3209 73/40.5 R
2008/0078188 A1 4/2008 Matheoud et al.
2011/0005639 A1 1/2011 Weh et al.

FOREIGN PATENT DOCUMENTS

DE 9310530 U1 9/1993
DE 19501332 A1 7/1996
DE 10117329 A1 10/2002
DE 102004038460 A1 3/2006
DE 102008060127 A1 6/2010
EP 0779470 A1 6/1997
EP 0949444 A2 10/1999
EP 2229551 A1 9/2010
EP 2466186 A1 6/2012
WO WO 0133130 A1 5/2001

* cited by examiner

DEVICE FOR FUELLING MOTOR VEHICLES WITH LIQUEFIED GAS

CROSS-REFERENCE TO PRIOR APPLICATIONS

This application is a U.S. National Phase application under 35 U.S.C. § 371 of International Application No. PCT/EP2016/075730, filed on Oct. 26, 2016, and claims benefit to German Patent Application No. DE 10 2015 118 830.9, filed on Nov. 3, 2015. The International Application was published in German on May 11, 2017 as WO 2017/076706 under PCT Article 21(2).

FIELD

The invention relates to a device for fueling motor vehicles with a fluid used as a fuel and composed of liquefied gas, in particular liquefied natural gas, comprising at least one storage container, a cooling device, at least one conveying device, by means of which the fluid can fed from the storage container to at least one fueling device, by means of which motor vehicles can be fueled with the fluid, and at least one line used for supplying the fluid to the fueling device.

BACKGROUND

Fuels of this kind, also referred to as cryogenic fuels, the boiling point or critical temperature of which is far below usual ambient temperatures at the pressure prevailing in the storage container, are becoming increasingly important due to increased energy demand and the increased environmental impact of conventional energy sources. They are highly susceptible to evaporation as a result of pressure and temperature changes.

Is it known to operate internal combustion engines of motor vehicles using natural gas. Since natural gas has a very low storage density at normal atmospheric pressure in comparison with, for example, diesel fuel, and a lower volumetric heating value than diesel, the natural gas is compressed to approximately 200 bar (CNG=compressed natural gas) or liquefied by reducing the temperature to −162° C. (LNG=liquefied natural gas), such that a sufficient amount of energy can be carried in the motor vehicle.

In the case of LNG, a portion of the natural gas constantly evaporates on account of the heat from the surroundings. The more volatile constituents of the gas are mainly found in the gaseous portion of the natural gas, which constituents have a higher vapor pressure or lower boiling temperature. Removing a portion of the natural gas present in gaseous form in the storage container in the long term results in enrichment of higher hydrocarbons, in particular propane, in the cryogenically liquefied portion of the natural gas.

The high proportion of propane can be damaging to internal combustion engines. Moreover, the mixture composition changes with time, which is undesirable.

In addition to land vehicles, such as buses, trucks and passenger vehicles, the term "vehicles" also includes watercraft and aircraft.

EP 2 229 551 A1 relates to a coupling for supplying a cryogenic fluid, in particular LNG, to a motor vehicle tank. For this purpose, the coupling is connected to a control line, which is pressurized by means of a control fluid, for example compressed air at 10 bar. The release of the control pressure at the control line results in the release of the fluid flow in the main line for supplying the fluid, such that it is ensured that the operator of the coupling does not come into contact with the cryogenic medium.

According to EP 0 779 470 A1, a pressure feed tank is connected to a coupling via a supply line and a storage container is connected to said coupling via a return line, in order to fuel the motor vehicle with cryogenic fuel flowing out of the pressure feed tank via the coupling. The output of the supply line and the input of the return line are in this case arranged in the liquid cryogenic fuel of the pressure feed tank and storage container, such that the liquid cryogenic fuel of the pressure feed tank can be guided via said connection to the coupling or to the motor vehicle tank and back into the liquid cryogenic fuel of the storage container. This makes it possible to cool the hose and the warm motor vehicle tank, the warmed liquid or gaseous cryogenic fuel being supplied to the liquid phase of the storage container.

DE 195 01 332 A1 relates to a method for cooling a coaxial pipe system composed of at least two coaxial, mutually spaced pipes of a superconducting cable, which is arranged in a highly thermally insulating sheath, a liquid gas being guided through the inner pipe. In order to keep both the inner pipe and the pipe surrounding the inner pipe at a given temperature, the annular gap, which is sealed off at the ends, between the inner pipe and the pipe surrounding same is filled with a gas or gas mixture, the condensation temperature of which corresponds to the boiling point of the liquid gas flowing in the inner pipe, and is preferably higher, such that the gas or a gas of the gas mixture condenses on the inner pipe, and the condensate dripping off cools the outer pipe.

A device is known from DE 10 2004 038 460 A1 for filling a container with liquid gas from a reservoir, a liquefied gas being drawn from the reservoir and supplied to the container via a fluid feed line by means of a conveying device. Furthermore, gaseous gas is drawn from the container to be filled, liquefied at least in part by means of cooling in a heat exchanger and the liquefied gas is supplied to the container to be filled.

Moreover, gas stations are known from U.S. Pat. No. 5,315,831 A and from U.S. Pat. No. 5,537,824 A by means of which natural-gas-operated motor vehicles can be refueled with LNG and/or CNG.

The refueling of motor vehicles with gaseous fuels is also known from DE 721 995 A and DE 10 2008 060 127 A1.

Furthermore, DE 16 50 060 A relates to a flexible conduit composed of concentric corrugated pipes for transporting liquids or gases, for example for forward and return flow in district heating lines.

SUMMARY

In an embodiment, the present invention provides a device for fueling motor vehicles with a fluid used as a fuel and composed of liquefied gas, in particular liquefied natural gas, comprising: at least one storage container; a cooling device; at least one conveying device configured to feed the fluid from the at least one storage container to at least one fueling device for motor vehicles; and at least one line configured to supply the fluid to the fueling device, wherein the at least one line comprises a media-conveying central pipeline as a medium pipe and at least one additional media-conveying pipeline that is arranged concentrically with respect to the central pipeline and defines an annular space together with the media-conveying central pipeline, the media-conveying central pipeline and the at least one annular space being configured to supply and return the fluid or a gas flow, and wherein the at least one additional media-conveying pipeline is surrounded by a jacket pipe, the jacket pipe being thermally insulated from the at least one additional media-conveying pipeline and the media-conveying central pipeline and comprising a metal corrugated pipe such that the media-conveying central pipeline and at least one media-conveying annular space are not thermally insulated from one another.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
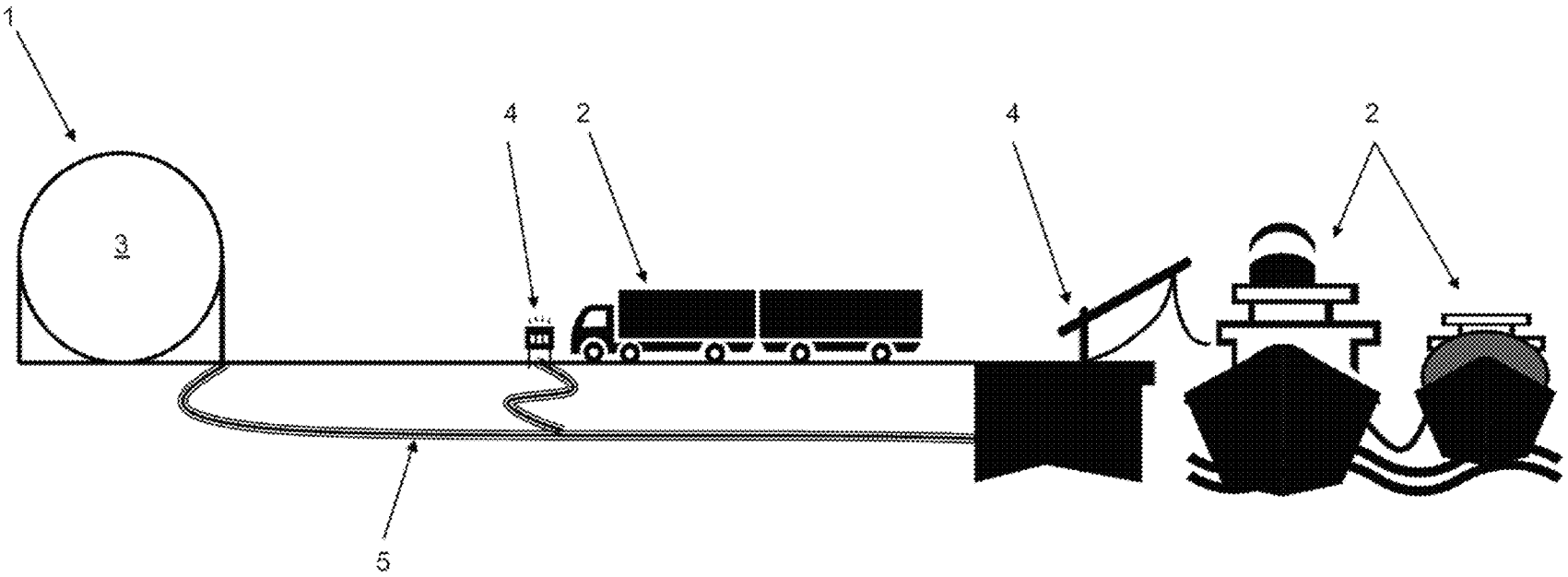
FIG. 1 is a main view of a device according to the invention comprising a line for fuel.

According to the invention, a device is thus provided in which the line comprises a media-conveying central pipeline as the medium pipe and at least one additional media-conveying pipeline that is arranged concentrically or coaxially with respect to the central pipeline and defines an annular space together with the enclosed pipeline, the central pipeline and the at least one annular space being used to supply and return the fluid composed of the liquefied gas or a gas flow and the outer pipeline being surrounded by a, for example, concentric jacket pipe as the outer pipe, the jacket pipe being thermally insulated from the outer pipeline, the central pipeline being designed as a metal corrugated pipe and the central pipeline and at least one media-conveying annular space not being thermally insulated from one another. The central pipeline and the at least one annular space are used for supplying and returning the fuel. The outer pipeline is surrounded by an also concentric jacket pipe, which encloses a thermally insulating material. The pipelines and the jacket pipe are each designed as thermally self-compensating metal corrugated pipes, the central pipeline and the media-conveying annular space not being thermally insulated from one another. According to the invention, heat is thus removed from the returned gas by the supplied fuel on account of the concentric structure of the lines in order to cool and/or liquefy the gas. The coaxial separating wall between the pipelines forms an optimal exchange surface on account of the design as a corrugated pipe and the resulting increased surface area.

Moreover, it is particularly advantageous if the pipelines and the jacket pipe are each designed as thermally self-compensating metal corrugated pipes, in order to thus achieve a particularly flexible line which can also be laid in spaces having relatively small radii.

In addition, it has proven particularly practical if all pipelines and the jacket pipe are arranged so as to be coaxial to one another.

In another, also particularly promising variant of the invention, an additional pipeline which divides the annular space into an inner annular space and an outer annular space is arranged in the annular space between the central pipeline as the medium pipe and the pipeline. As a result, it is possible to establish a "standby mode", in which fuel is continuously drawn from the storage container and conveyed through the central pipeline to a flow-reversal region in a line portion of the line that is remote from the storage container. The fuel is then conveyed through the inner annular space back into the storage container. As a result, a continuous flow is produced in the line, which makes it possible to prevent undesirable heating. Furthermore, a desired fuel supply is available at all times for refueling, such that the refueling process can be started without delay once the line has been connected to the motor vehicle.

It is particularly advantageous in this case if the outer annular space is designed to conduct away the gas volumes forced out of the motor vehicle tank during fueling. The displaced gaseous volumes, also referred to as "boil-off gases", can thus be reliably conveyed through the outer annular space into the storage container, without being exchanged with the fuel supplied to the motor vehicle, in order to liquefy said gaseous volumes again in said storage container. The gaseous constituents can therefore be prevented from escaping from the motor vehicle tank into the surroundings and undesirable environmental impacts can be averted.

For this purpose, according to a particularly useful embodiment of the line, the outer annular space is provided with a separate inlet opening and a separate outlet opening, such that the boil-off gas can be returned separately from the fuel, but through the same line.

In addition, it is particularly promising if the device comprises a storage container for LNG and if the line connects the storage container to a fueling device. As a result, relatively large distances between the fueling device and a central, for example underground, storage container can be overcome without difficulty by means of the line. The storage container can in this way also be connected to a plurality of fueling devices at optionally different locations.

In another, also particularly expedient embodiment of the invention, a leakage-monitoring device is arranged in the outer annular space between the jacket pipe and the outer pipeline. As a result, leaks caused by damage or wear can be quickly and reliably identified and the supply of fuel stopped. Fiber-optic temperature measurement methods, for example, are suitable for this purpose, glass fibers for example being used as sensors for detecting leaks. Alternatively, a pressure difference in the outer annular space can be used as an indicator for a leak.

The annular space between the jacket pipe and the outer pipeline could be thermally insulated by means of a vacuum. It is also particularly practical if a thermally insulating material is provided in the annular space between the jacket pipe and the outer pipeline, which insulating material comprises a foam, in particular a polyurethane foam (PUR), as a fundamental constituent. The insulating material lends both high mechanical stability and load-bearing capacity to the line, such that the risk of damage is significantly reduced. In addition, the multi-walled nature of the line prevents liquid or gaseous constituents from escaping into the surroundings. Preferably, the line is designed to be self-compensating with regard to the thermal expansion thereof as a corrugated pipe.

Furthermore, it is also advantageous if the line is provided at least in portions with a circumferential reinforcement made of a braided material. Armoring of this kind comprises, for example, a woven braided material and/or a non-woven braided material, it being possible to select any desired material for the armoring. In this way, the mechanical properties are further improved.

A device 1 according to the invention and intended for fueling various vehicles and watercraft is explained below with reference to FIGS. 1 to 4. The device 1 makes it possible to fuel various motor vehicles 2 with a liquefied gas that is used as a fuel, in particular liquefied natural gas (LNG). For this purpose, the invention comprises a storage container 3 designed as an above-ground tank for storing the liquefied gas, to which storage container a cooling device is assigned in order to liquefy the gas by means of cooling to a suitable temperature range below −160° C. A line 5 designed as a corrugated pipe is arranged between a relevant fueling device 4 designed as a gas station, which, as is known per se, is correspondingly equipped for the various types of motor vehicle.

Figure 2:
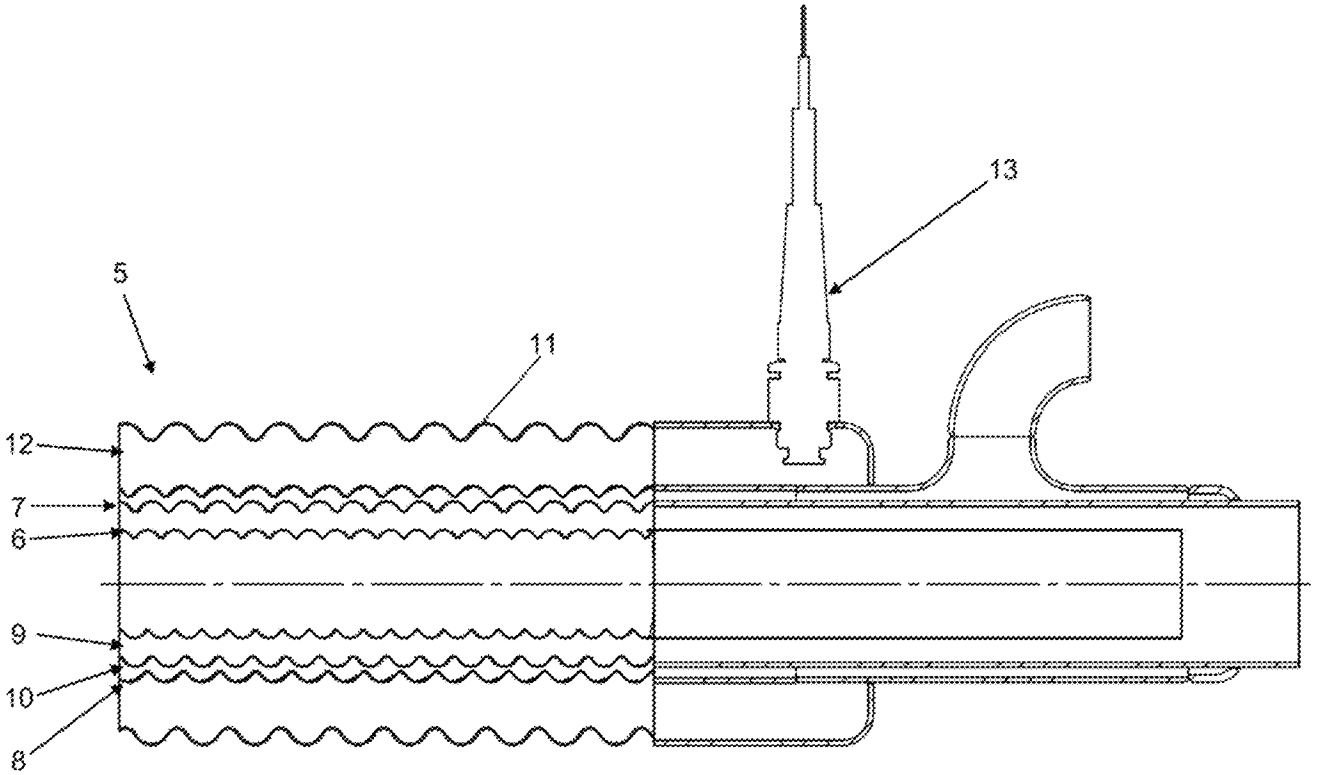
FIG. 2 is a perspective, partially sectional view of a line portion of the line shown in FIG. 1.

The structural design of the line 5 is explained in greater detail with reference to FIG. 2. The line 5 comprises a media-conveying central pipeline 6 as the medium pipe, through which the fuel can be conveyed from the storage container 3 to the relevant fueling device 4. Said central pipeline is concentrically enclosed by two additional media-conveying pipelines 7, 8, such that two media-conveying annular spaces 9, 10 are formed, the function of which will be explained below with reference to FIGS. 3 and 4. Finally, an outer jacket pipe 11 is provided as the outer pipe, which encloses an annular insulating material 12 between the pipeline 8 and the jacket pipe 11, in order to thus thermally insulate the line 5. In addition, the pipelines 6, 7, 8 and the jacket pipe 11 are designed as thermally self-compensating metal corrugated pipes. The central pipeline 6 and the media-conveying annular spaces 9, 10 are not thermally insulated from one another. Since the central pipeline 6 and the two media-conveying annular spaces 9, 10 are merely separated by the wall surface of the respective pipelines 6, 7, but are not thermally insulated, heat is removed from the medium conveyed in the annular spaces 9, 10 by means of the fuel conveyed in the central pipeline 6 and said medium is correspondingly cooled. The coaxial separating wall between the pipelines 6, 7, 8 in this case forms an optimal exchange surface on account of the design as a corrugated pipe. On account of the concentric structure, the line is also better thermally insulated against the surroundings, only one single outer layer of insulation being required. For checking purposes, a leakage-monitoring device 13 is assigned to the outer annular space 10 between the jacket pipe 11 and the pipeline 8, and thus makes it possible to continuously monitor the line for possible leaks.

Figure 3:
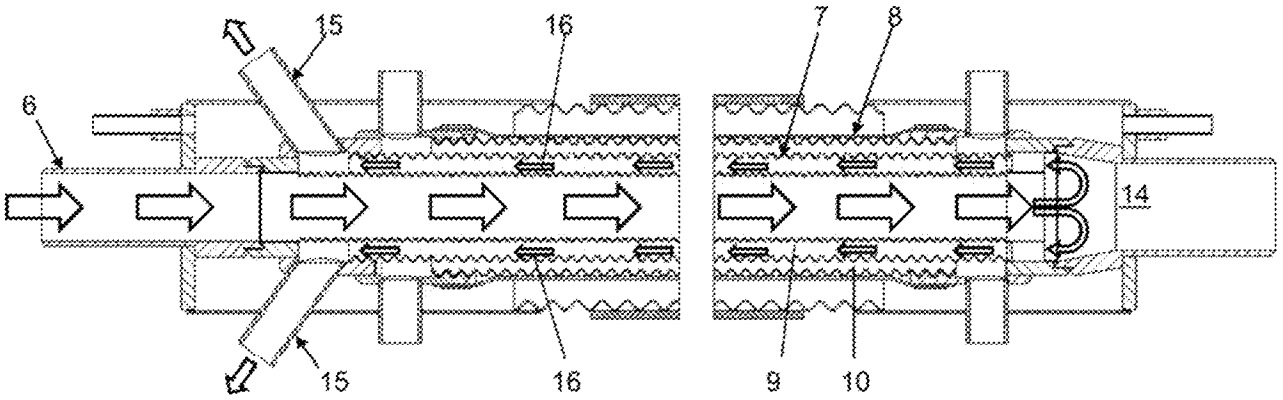
FIG. 3 shows a standby mode of the device.
Figure 4:
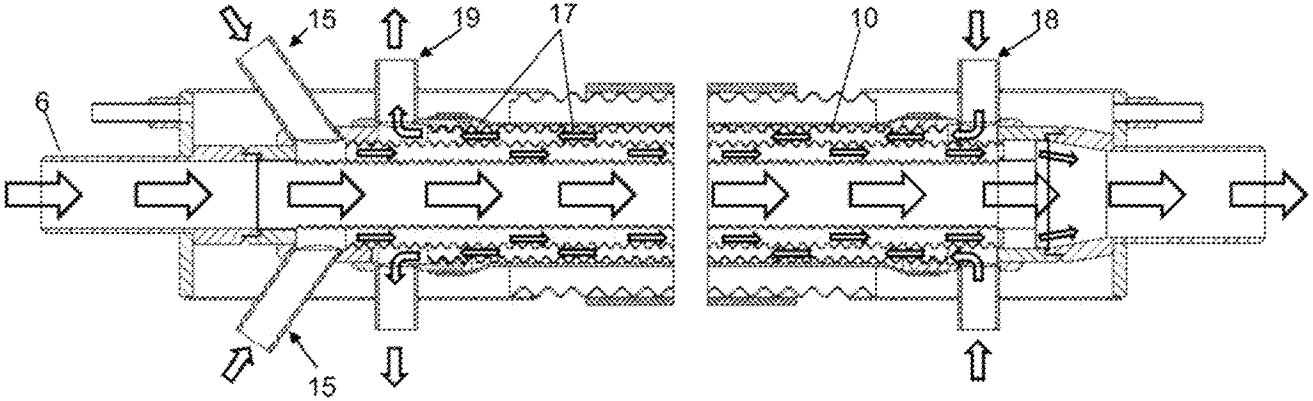
FIG. 4 shows a removal mode of the device.

In addition to the central pipeline 6 used for transporting the fuel, the two separate annular spaces 9, 10 between the concentric lines 7, 8 allow two different operating states, which will be described in more detail below with reference to FIGS. 3 and 4. With regard to the first operating state, FIG. 3 shows a "standby mode", in which fuel is continuously drawn from the storage container 3 and conveyed through the central pipeline 6 to a flow-reversal region 14 upstream of a sealed line end in a line portion remote from the storage container 3. The fuel is then conveyed in the direction of the arrow 16 through the inner annular space 9 and two line connections 15 back into the storage container 3. Therefore, there is a continuous flow in the line 5, as a result of which undesirable heating can be prevented.

With regard to the second operating state, the outer annular space 10 is used to conduct away the gaseous volumes, also referred to as "boil-off gases", forced out of a motor vehicle tank during fueling of the motor vehicle 2. Said gaseous volumes are taken from the motor vehicle tank through a separate inlet opening 18, the outer annular space 10 and an outlet opening 19, not connected to the central pipeline 6, in the direction of the arrow 17 into the storage container 3, in order to liquefy said gaseous volumes in said storage container. The gaseous constituents can therefore be prevented from escaping from the motor vehicle tank into the surroundings and undesirable environmental impacts and dangers can be averted. In this operating mode, the fuel is supplied both through the central pipeline 6 and through the line connections 15 and the first, inner annular space 9. In this way, the volumetric flow rate is increased and the refueling process is thus shortened.

Figure 5:
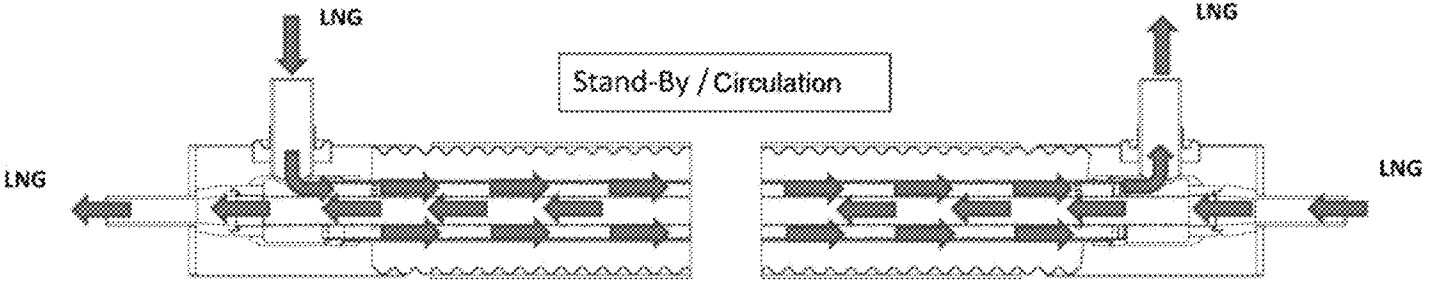
FIG. 5 shows a standby mode of a variant of the invention.
Figure 6:
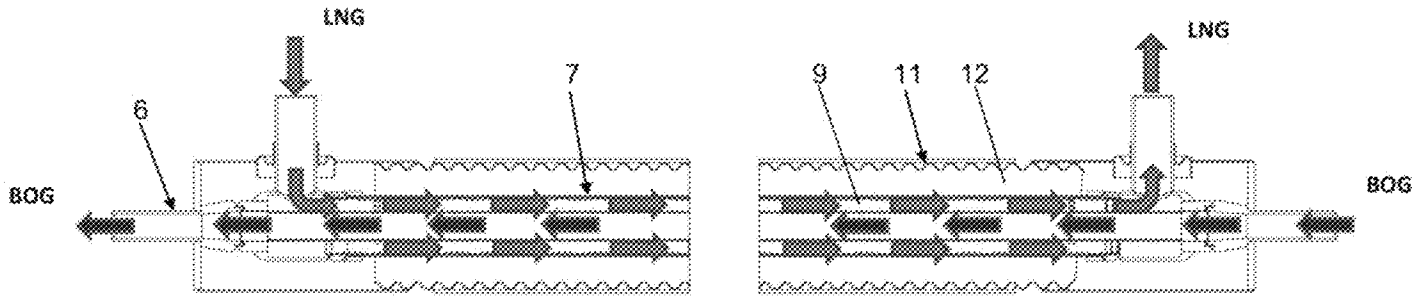
FIG. 6 shows a removal mode of the device shown in FIG. 5.

Additionally, another variant of the device 1 is shown in FIGS. 5 and 6. In this case, the pipeline 6 is concentrically enclosed by only one media-conveying pipeline 7, as a result of which a media-conveying annular space 9 is formed. An outer jacket pipe 11 forms the outer pipe, which encloses an annular insulating material 12 between the annular space 9 and the jacket pipe 11 in order to thus thermally insulate the pipelines 6, 7. The central pipeline 6 and the media-conveying annular space 9 are not thermally insulated from one another, and therefore they are merely separated by the wall surface of the pipeline 6 but are not thermally insulated.

As illustrated by directional arrows, in the operating mode shown in FIG. 5 of supplying liquefied natural gas and in the operating mode shown in FIG. 6 of extracting boil-off gases BOG, a type of circulation of the liquefied natural gas, present in the storage container, through the pipeline 7 is selected in each case. In this way, heat is removed from the liquefied natural gas or boil-off gas alternatively conveyed in the pipeline 6 by means of the pipeline 7 and said gas is correspondingly cooled, it being possible to liquidize the boil-off gases by removing the heat.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 device
2 motor vehicle
3 storage container
4 fueling device
5 line
6 central pipeline
7 pipeline
8 pipeline
9 annular space
10 annular space
11 jacket pipe
12 insulating material
13 leakage-monitoring device
14 flow-reversal region
15 line connection
16 arrow direction
17 arrow direction
18 inlet opening
19 outlet opening

The invention claimed is:

1. A device for fueling motor vehicles with a fluid used as a fuel and composed of liquefied gas the device comprising:

at least one storage container;

a cooling device;

at least one conveying device configured to feed the fluid from the at least one storage container to at least one fueling device for motor vehicles; and at least one line configured to supply the fluid to the fueling device, wherein the at least one line comprises a media-conveying central pipeline as a medium pipe and at least one additional media-conveying pipeline that is arranged concentrically with respect to the central pipeline and defines an annular space together with the media-conveying central pipeline, the media-conveying central pipeline and the at least one annular space being configured to supply and return the fluid or a gas flow, wherein the at least one additional media-conveying pipeline is surrounded by a jacket pipe, wherein the jacket pipe is thermally insulated from the at least one additional media-conveying pipeline and the media-conveying central pipeline and comprises a metal corrugated pipe, wherein the media-conveying central pipeline and at least one media-conveying annular space are not thermally insulated from one another and each comprise a respective metal corrugated pipe, wherein the device further comprises a leakage-monitoring device arranged in an outer annular space between the jacket pipe and the at least one additional media-conveying pipeline, and wherein the outer annular space comprises a sealed and evacuated insulation space thermally vacuum insulating the jacket pipe from the at least one additional media-conveying pipeline and the media-conveying central pipeline.

2. The device according to claim 1, wherein the pipelines and the jacket pipe comprise in each case thermally self-compensating metal corrugated pipes.

3. The device according to claim 1, wherein all pipelines and the jacket pipe are arranged coaxially to one another.

4. The device according to claim 1, further comprising an additional pipeline which divides the annular space into a first annular space and a second outer annular space, the additional pipeline being arranged between the media-conveying central pipeline and the at least one additional media-conveying pipeline.

5. The device according to claim 4, wherein the second annular space is configured to conduct away gas volumes forced out of a motor vehicle tank during fueling.

6. The device according to claim 4, wherein the second annular space is provided with a separate inlet opening and a separate outlet opening.

7. The device according to claim 1, wherein the at least one storage container comprises a liquefied natural gas (LNG) storage container, and wherein the at least one line connects the LNG storage container to the at least one fueling device.

8. The device according to claim 4, further comprising a thermally insulating material arranged at least in portions in the outer annular space between the jacket pipe and the at least one additional media-conveying pipeline.

9. The device according to claim 1, wherein the at least one line is self-compensating.

10. The device according to claim 1, wherein the at least one line is provided, at least in portions, with a circumferential reinforcement comprised of armoring.

11. The device according to claim 4, wherein the at least one conveying device comprises at least one line connection that is in direct fluid communication with the first annular space and in fluid communication with the at least one storage container.

12. The device according to claim 11, wherein in the line comprises a flow-reversal region upstream of a sealed line end in a line portion remote from the at least one storage container, the flow-reversal region configured to receive the fluid from the central pipeline and reverse the flow through back to the at least one storage container via the first annular space and the at least one connection line.

13. The device according to claim 6, wherein the second annular space is configured to receive a gas volume from a motor vehicle tank via the separate inlet opening, and conduct the gas volume to the at least one storage container via the separate outlet opening.

* * * * *